US011085195B2

(12) United States Patent
Burk

(10) Patent No.: US 11,085,195 B2
(45) Date of Patent: Aug. 10, 2021

(54) BLADE ARRANGEMENT

(71) Applicant: NATIONAL FLOORING EQUIPMENT, INC., Minneapolis, MN (US)

(72) Inventor: Matthew C. Burk, Forest Lake, MN (US)

(73) Assignee: National Flooring Equipment, Inc., Minneapolis, MN (US)

( * ) Notice: Subject to any disclaimer, the term of this patent is extended or adjusted under 35 U.S.C. 154(b) by 0 days.

(21) Appl. No.: 16/218,827

(22) Filed: Dec. 13, 2018

(65) Prior Publication Data

US 2020/0190835 A1 Jun. 18, 2020

(51) Int. Cl.
*E04G 23/00* (2006.01)

(52) U.S. Cl.
CPC ..... *E04G 23/006* (2013.01)

(58) Field of Classification Search
CPC ..... E04G 23/006; E04D 15/003
USPC ..... 299/37.1, 37.2, 36.1, 38.1
See application file for complete search history.

(56) References Cited

U.S. PATENT DOCUMENTS 888,775 A * 5/1908 Ackermann ..... A47L 13/08 30/170
2,005,630 A * 6/1935 Overell ..... E04G 23/006 299/37.1
2,535,253 A * 12/1950 Anderson ..... A01G 20/30 30/128
4,189,854 A 2/1980 Haynes
4,683,657 A * 8/1987 Anderson ..... B26D 3/28 15/93.1
5,641,206 A * 6/1997 Craft ..... E04G 23/006 299/37.1
5,772,284 A * 6/1998 Lindsey ..... E04G 23/006 15/93.1
6,135,566 A 10/2000 Anderson
6,343,981 B1 * 2/2002 Buchanan ..... E04G 23/006 156/763
6,609,762 B2 8/2003 Anderson
6,813,834 B2 11/2004 Anderson
7,082,686 B2 8/2006 Anderson
7,093,906 B1 * 8/2006 Davidson ..... E02F 3/7618 15/93.1
7,562,412 B1 7/2009 Anderson
2005/0060891 A1 3/2005 Anderson
2009/0188116 A1 * 7/2009 van Deursen ..... A47L 13/022 30/170
2009/0320299 A1 * 12/2009 Kuhn ..... B28D 1/183 30/169
2011/0146083 A1 * 6/2011 Lin ..... A47L 13/08 30/169

(Continued)

FOREIGN PATENT DOCUMENTS

JP 05202621 A * 8/1993 ..... E04G 23/006
JP 2003336404 A * 11/2003 ..... E04G 23/006
WO 2009158603 12/2009

*Primary Examiner* — Janine M Kreck
*Assistant Examiner* — Michael A Goodwin
(74) *Attorney, Agent, or Firm* — Thomas J. Nikolai; DeWitt LLP

(57) ABSTRACT

A floor stripping machine blade of a blade assembly has a leading edge, when the blade assembly is attached to a floor stripping machine, at an angle that is other than perpendicular to the direction of travel of the floor stripping machine, said angle of the blade's leading edge being fixed or adjustable.

13 Claims, 8 Drawing Sheets

(56) References Cited

U.S. PATENT DOCUMENTS

| | | | | |
|---|---|---|---|---|
| 2017/0297319 | A1* | 10/2017 | May | E04G 23/006 |
| 2017/0361644 | A1* | 12/2017 | Landwehr | A47L 1/06 |
| 2018/0371770 | A1* | 12/2018 | Anderson | E04G 23/006 |

* cited by examiner

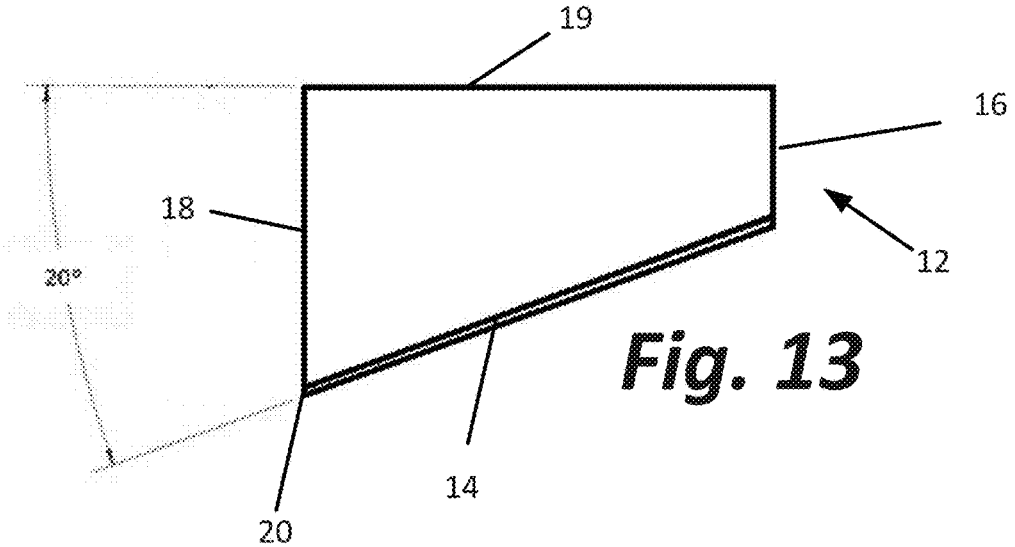
Fig. 13
Fig. 14
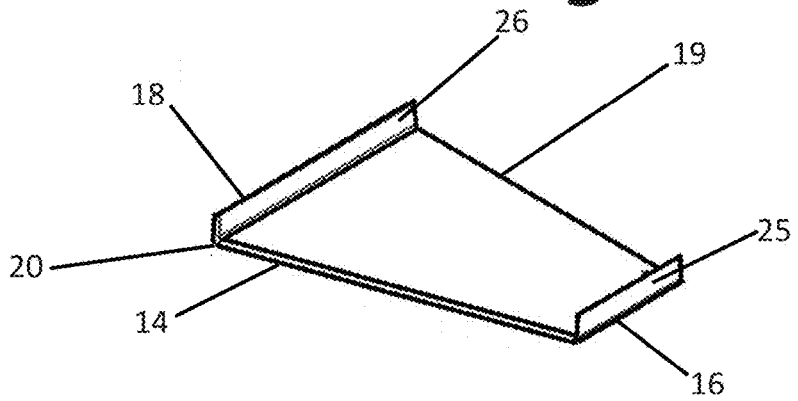
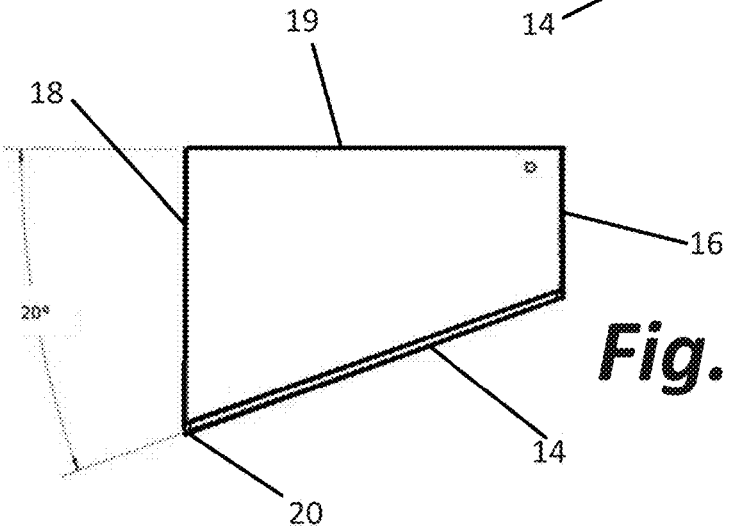
Fig. 15

BLADE ARRANGEMENT

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

I. Field of the Invention

The present invention relates to removal of floor coverings. More specifically, this invention relates to blades attached to a floor covering removal machine which engage and lift the floor covering from the floor and also scrape away from the floor the adhesive used to secure the floor covering to the floor.

II. Related Art

Various machines specifically adapted to remove floor coverings from a floor are known in the art. Some are walk-behind style machines. Examples of such machines are shown in U.S. Pat. No. 6,135,566, entitled "Self-Propelled Floor Stripper", granted to Martin L. Anderson on Oct. 24, 2000, and now assigned to National Flooring Equipment, Inc., and in U.S. Pat. No. 6,609,762, entitled "Walk Behind Floor Stripping Machine with Hydraulic Drive" granted to Martin L. Anderson on Aug. 26, 2003, and now also assigned to National Flooring Equipment, Inc. For larger floor removal projects, ride-on floor stripping machines are used. An example of such a ride-on machine is shown in U.S. Pat. No. 7,562,412, entitled "Battery Powered riding Floor Stripping Machine", granted to Martin L. Anderson on Jul. 21, 2009, and now assigned to National Flooring Equipment, Inc.

The aforementioned walk-behind and ride-on floor stripping machines all have blade holders adapted to receive and hold replaceable scraping blades. When the machine is in use, the weight of the machine presses down on the attached blade. The machine also drives the blade forward between the floor and the floor covering to separate the floor covering from the floor. The blades are also used to remove from the floor residual adhesive that was used to fasten the floor covering to the floor.

Machines of the type described above have been employed to remove various types of floor coverings including carpet, vinyl, ceramic tile, wood and stone. Blades of differing designs have been employed based on the type of floor covering to be removed. Examples include the shank blades of the types shown in U.S. Pat. Nos. 6,813,834 (granted Nov. 9, 2004) and 7,082,686 (granted Aug. 1, 2006) both to Martin L. Anderson and now assigned to National Flooring Equipment, Inc. The blades shown in these patents are highly effective for the removal of a variety of flooring materials and are particularly effective for removal of ceramic tile and stone.

The shank blades illustrated in these patents, like the other blades used with floor removal machines, have a leading, floor-engaging edge that extends along a line perpendicular to the direction of travel of the machine. The leading edges of the blades engage the floor and separate the floor covering from the floor along this line such that the floor covering rolls over upon itself in front of the machine or is diverted to the sides by the machine's blade holder. This generally works well given the power, weight and speed of such machines.

However, for certain applications there has been an ongoing need for blades having different blade profiles. For example, standard blades are not particularly adapt at removing floor covering from along walls or windows or in corners. In other situations, fixtures are present in rooms and it is necessary to work around these fixtures when removing floor coverings. Such fixtures are not always rectangular such that use of a blade with a different blade profile would be advantageous. Also, some adhesives employed to install floor coverings are sufficient hard and bonded so tightly to the floor that these adhesives are difficult to remove using a standard blade.

SUMMARY OF THE INVENTION

The present invention solves the foregoing problems by providing a blade leading edge at an angle other than 90° from the direction of travel of the machine to which the blade is attached. More specifically, the present invention provides various floor stripping blade assemblies adapted to be attached to a floor stripping machine.

The floor stripping blade assemblies include a blade having a leading edge, i.e., the forward-most edge of the blade as the machine moves in a forward direction. The floor stripping blade assemblies also include a blade head coupled to the blade and a blade connector such as a blade shank. When a blade shank is used as the connector, the blade shank has a longitudinal axis and is adapted to be coupled to a receiver socket of the floor stripping machine in a specific way so each of the following three attributes exist: (1) the floor stripping blade assembly can rotate about the longitudinal axis of the blade shank and, thus, relative to the floor stripping machine; (2) a portion of the machine is supported by the floor stripping blade assembly when the leading edge of the blade is in a floor stripping position; and (3) when the leading edge is in a floor stripping position, the leading edge of the blade is at an angle within a range of between 5° and 45° from a line which is (a) parallel to the floor on which the machine is being driven, (b) perpendicular to the forward direction of travel (i.e., an imaginary line along which the machine travels when traveling straight and in the forward direction), and (c) passes through the forward-most point of the blade. This angle may be fixed, adjustable, or even infinitely adjustable within this range of angles.

The invention contemplates and includes various techniques for imparting the desired angle to the leading edge of the blade. In some embodiments, the blade, blade head and blade shank are integrally formed in such a way to provide this angle when the shank is inserted into the receiver socket of the floor stripping machine. In other embodiments, the socket itself is attached to the machine in a manner that imparts the desired angle to the leading edge of the blade when the blade shank is inserted into the socket.

In other embodiments, the blade head includes a blade holding assembly that clamps the blade to the blade head. When a standard blade holding assembly is used, a blade having a trailing edge and two side edges, in addition to the leading edge, may be employed. Such blades are designed so that the leading edge is neither parallel to the trailing edge nor perpendicular to the side edges to impart the desired angle to the leading edge. These blades can sometimes be flipped prior to being secured in the holder depending whether the forward-most point of the leading edge is desired to be on the left or right as the machine operator looks forward from the operating position on or behind the machine. Often, however, the leading edge angles back toward the main body of the blade, e.g., at an angle 30° from the bottom surface of the blade. Such blades are made to be attached in only one way with either the forward-most point to the right or to the left. In other cases, a standard rectangular blade is used and the blade head is designed so that the blade shank and blade holder assembly are angled relative to each other to impart the desired angle to the leading edge of the blade.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

FIG. 13 is a top plan view of a blade made in accordance with the present invention and adapted to be coupled to a blade head;

FIG. 14 is a perspective view of a winged blade made in accordance with the present invention and adapted to be coupled to a blade head; and FIG. 15 is a top plane plan view of the winged blade of FIG. 14.

DETAILED DESCRIPTION

Figure 1:
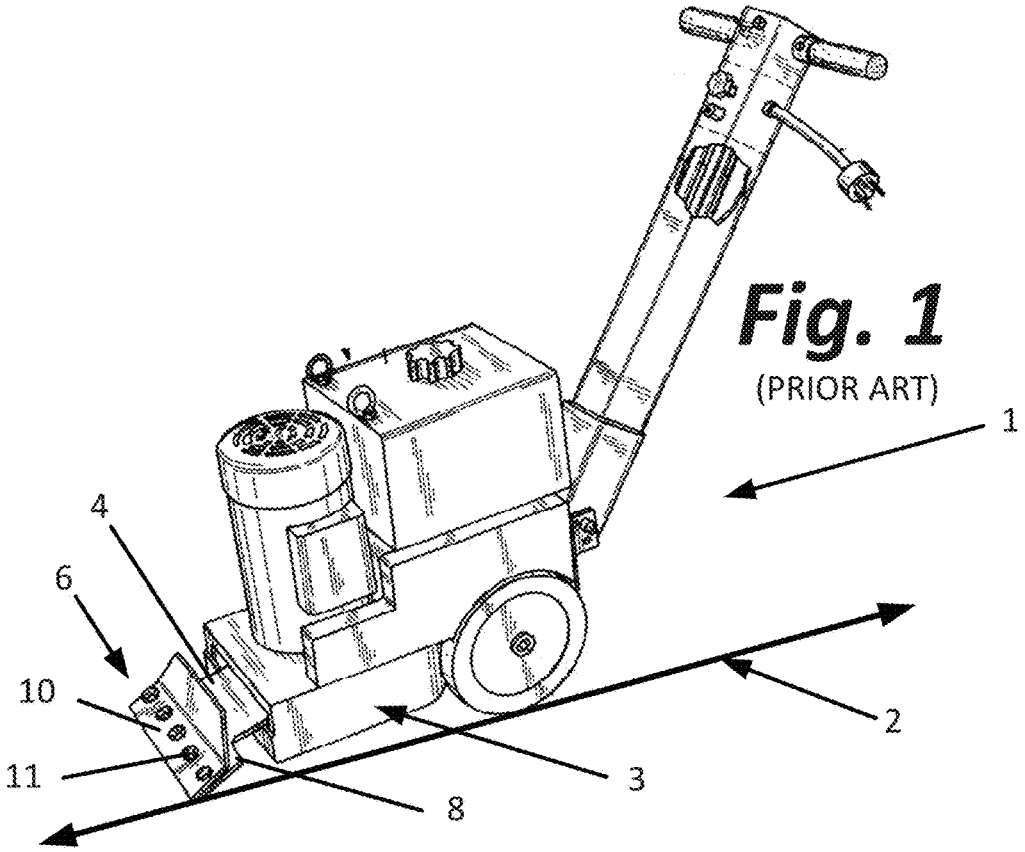
Fig. 1 (PRIOR ART)
FIG. 1 is a perspective view of a prior art walk-behind floor stripping machine.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

FIG. 1 shows a prior art walk-behind floor stripping machine 1 resting on a floor 2. Projecting forward of the main body 3 of the floor stripping machine 2 is a connector 4 which connects a blade head 6 to the main body 3 of machine 1. No blade is shown in the blade head of FIG. 1. The blade head 6 comprises a bottom plate 8, a top plate 10, and a plurality of connecting bolts 11.

Figure 2:
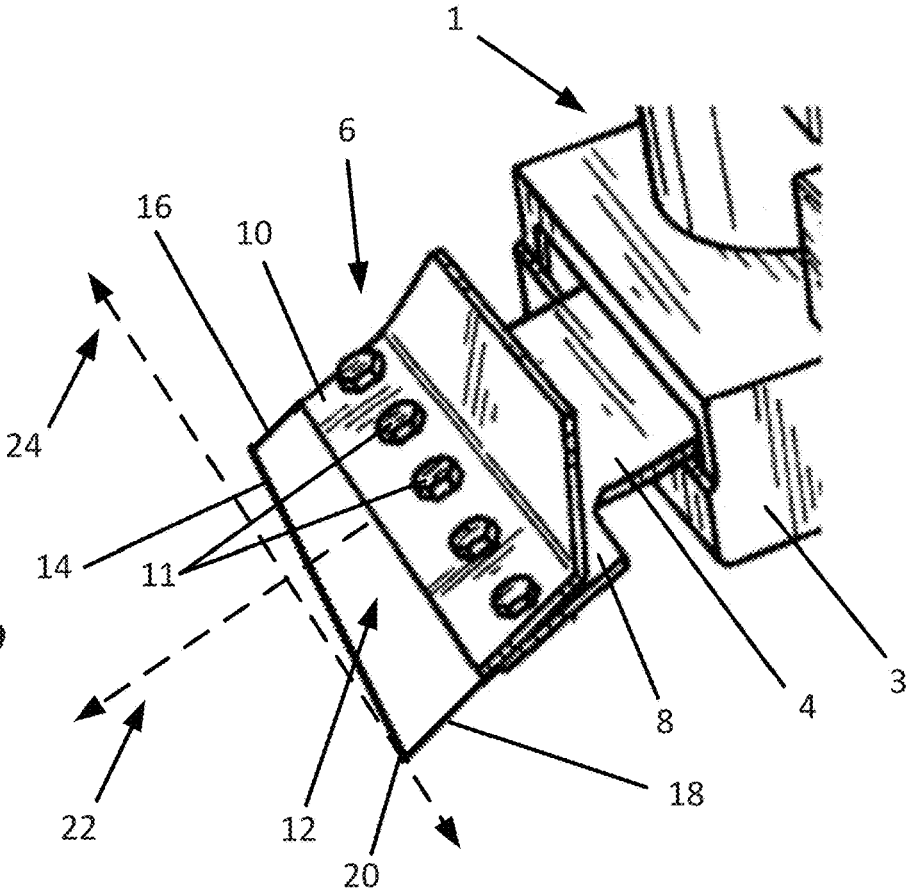
FIG. 2 is a perspective view of the blade head of the machine of FIG. 1 fitted with a blade made in accordance with the present invention.

In FIG. 2, a blade 12 made in accordance with the present invention is clamped between plates 8 and 10 of the blade head 6 to secure the blade 12 to the machine 1. This blade 12 is better shown in FIG. 13. Blade 12 has a leading edge 14 and side edges 16 and 18. The blade 12 also has a trailing edge 19 residing between the plates 8 and 10 of the blade head 6. The forward-most point 20 of blade 12 is shown in FIG. 2 on the right as the machine 1 is viewed from the front. The blade 12 is adapted so it can be flipped placing point 20 is on the left rather than the right. Alternatively, and particularly when the leading edge 14 extend at an angle (e.g., 30°) from the bottom surface back toward the top surface, such blades 12 can be made with the forward-most point either on the right or the left.

FIG. 2 also includes an imaginary line 22 representing the forward direction of travel of the machine. A second imaginary line 24 is also shown. Line 24 is parallel to the floor 2, perpendicular to the forward direction of travel of the machine represented by line 22, and also intersects the forward-most point 20 of the blade 12. Line 24 is also typically parallel to the trailing edge of the blade 12.

Significantly, the leading edge 14 of blade 12 is not co-linear with, nor parallel to, line 24. Instead, the leading edge 14 is angled from line 24. This angle preferably falls within the range of 5° and 45°. When the blade shown in FIG. 13 is used, this angle is 20°.

Figure 3:
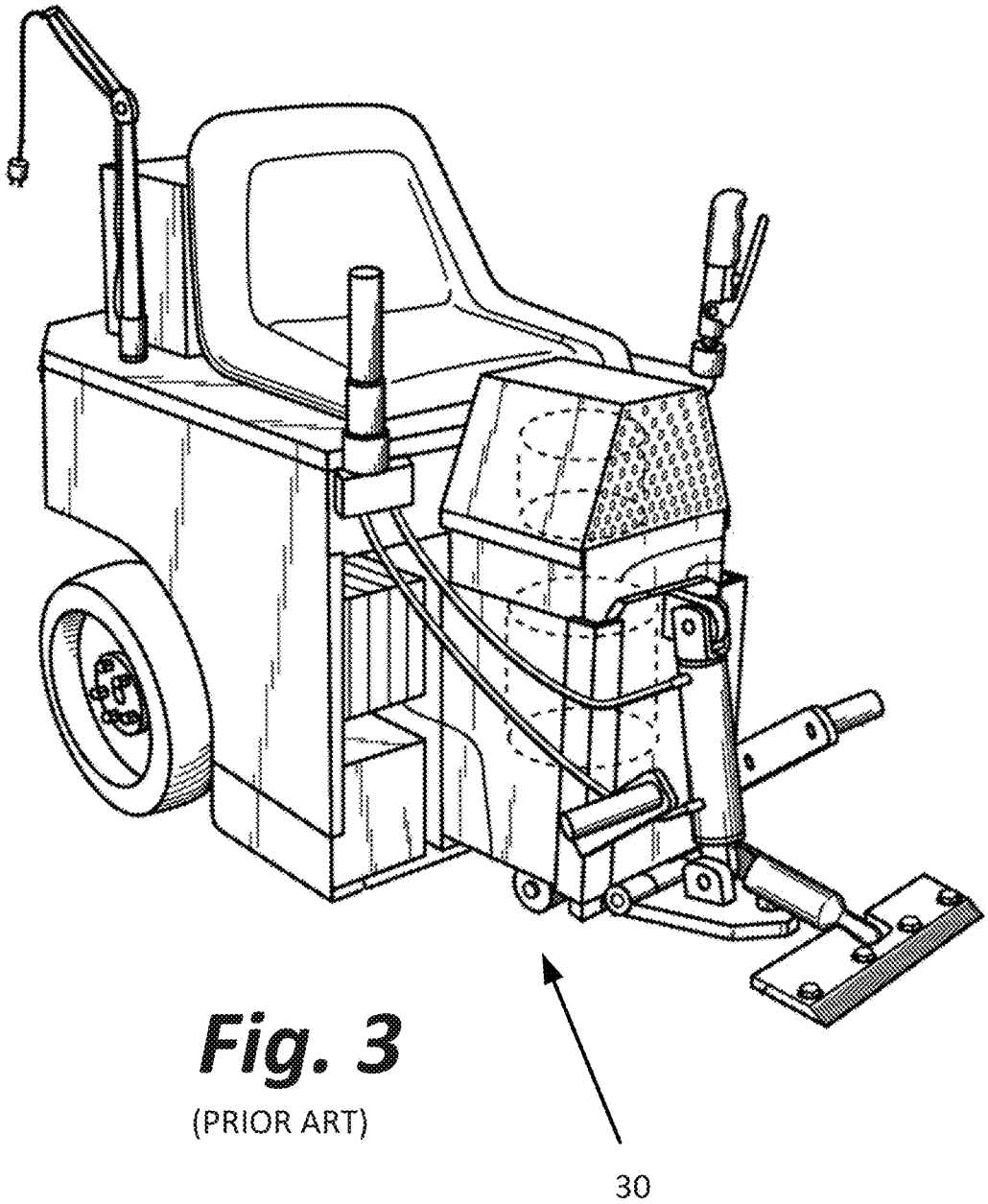
Fig. 3 (PRIOR ART)
FIG. 3 is a perspective view of a prior art ride-on floor stripping machine.
Figure 4:
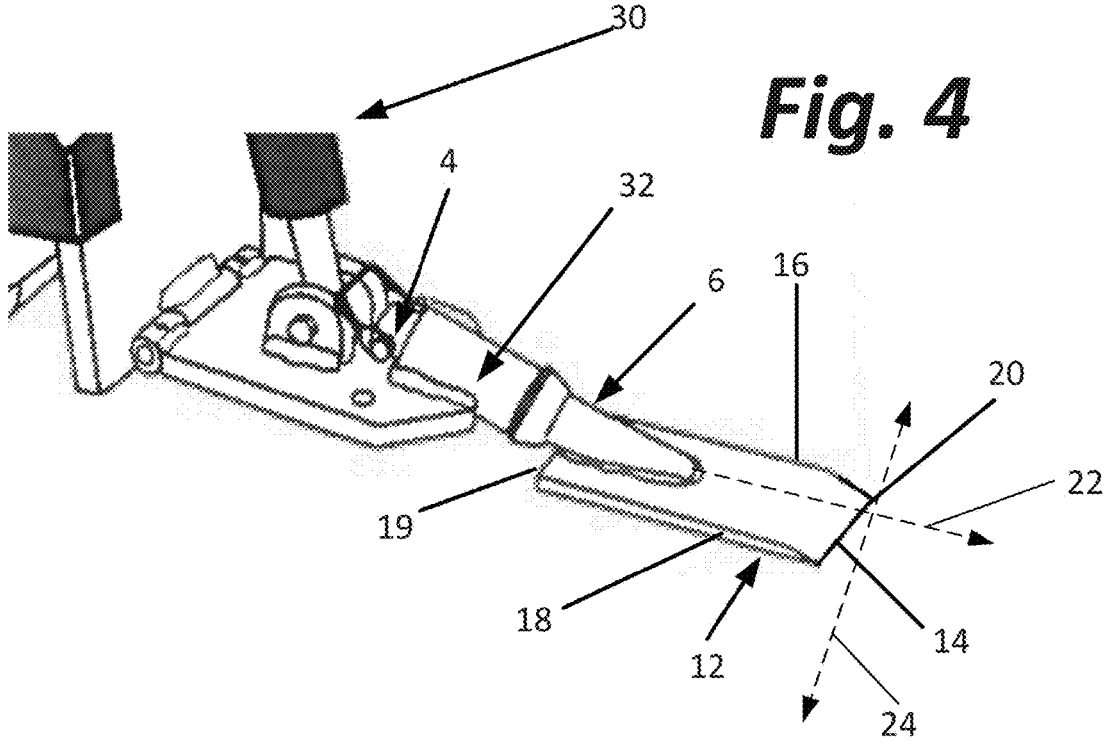
FIG. 4 is a perspective view of a shank style blade made in accordance with the present invention coupled to the machine of FIG. 3.
Figure 5:
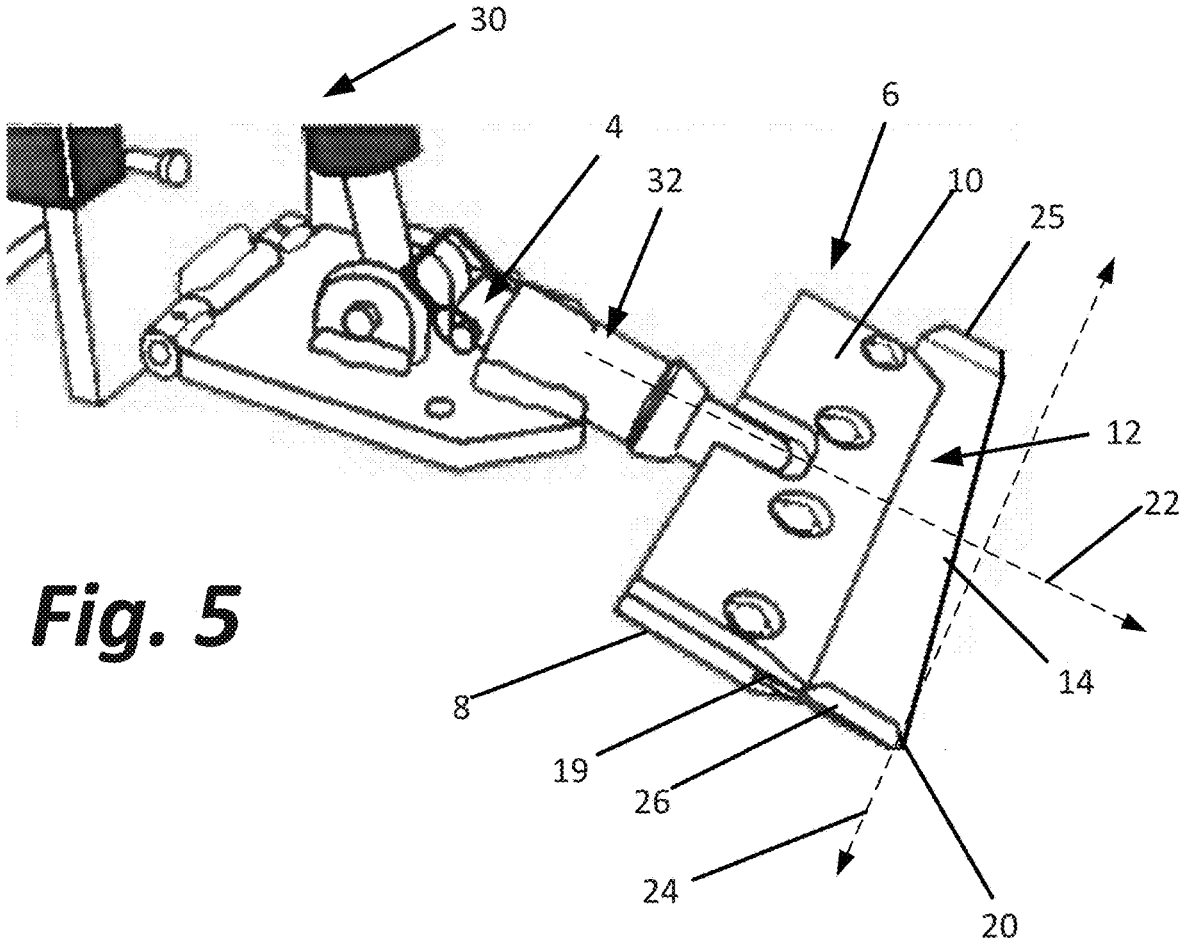
FIG. 5 is a perspective view of a winged blade made in accordance with the present invention coupled to the machine of FIG. 3.

FIG. 3 shows a prior art ride-on floor stripping machine 30 with no blade attached. FIGS. 4 and 5 illustrate two other blades 12 made in accordance with the present invention that may be attached to the ride-on floor stripping machine 30.

More specifically, FIGS. 4 and 5 show assemblies that may be used on the front end of ride-on floor stripping machine 30. Such assemblies include a socket or collar 32. In the embodiment illustrated in FIG. 4, the connector 4, blade head 6 and blade 12 are integrally formed as one piece. The connector 4 is in the form of a shank adapted to be received within the socket 32 to secure the blade head 6 and blade 12 to the machine 30. The connector 4 is able to rotate about its longitudinal axis within the socket 32. The blade head 6 and blade 12 rotate along with the connector (shank) 4.

The blade 12 illustrated in FIG. 4 has a leading edge 14, a pair of side edges 16 and 18 and a trailing edge 19. The forward-most point of blade 12 is again labeled 20.

FIG. 4 also shows an imaginary line 22 indicating the direction of travel of the machine 30 in the forward direction. Imaginary line 24 is parallel to the floor on which machine 30 rests, is perpendicular to line 22, and intersects point 20. These imaginary lines are presented to show that the leading edge 14 of the blade 12 is neither co-linear with, nor parallel to, line 24. Instead, the leading edge is at a pre-selected angle within the range of 5° and 45° from line 24. While the point 20 is on the right side of the blade 12 when the machine 30 is viewed from the front, this can be reversed when manufacturing the blade 12 without deviating from the invention.

The embodiment of FIG. 5 combines features of the embodiments of FIGS. 3 and 4. Like FIG. 3, the blade head 6 has a bottom plate 8 and a top plate 10. A rear portion of the blade 12 adjacent the trailing edge 19 is clamped between plates 8 and 10. Like FIG. 4, the connector 4 is in the form of a shank that is inserted into a collar 32 to secure the blade head 6 and blade 12 to the machine 30.

An imaginary line 22 is shown in FIG. 5. This line again represents the direction of travel of the machine 30 in the forward direction. Imaginary line 24 is parallel to the floor, perpendicular to line 22 and passes through the forward-most point 20 of blade 12. Again, and when the blade is in the scraping position as shown in FIG. 5, the leading edge of the blade is not perpendicular to the direction of travel, and is neither co-linear with nor parallel to the line 24. Instead, the leading edge extends at an angle from line 24. This angle is in the range of 5° and 45°. The blade 12 of FIG. 5 also has a pair of walls 25 and 26, sometimes referred to as wings, extending upwardly from the side edges of the blade 12.

A blade like that shown in FIG. 5 is shown in greater detail in FIGS. 14 and 15. The blades 12 shown in FIGS. 5, 14 and 15 have a trapezoid cross-section as best illustrated in FIG. 15. The blades are trapezoidal because sides 16 and 18 are parallel to each other, but the leading edge 14 is not parallel to the trailing edge.

In other embodiments of the invention, either the connector 4 or socket 32 may be positioned at an angle to impart the desired angle to the leading edge 14 of the blade 12 relative to lines 22 and 24. Also, the blade head 6 of the embodiments shown in FIGS. 2 and 5 may be modified to hold a rectangular blade, but with the leading edge 14 at the desired angle relative to lines 22 and 24. Three examples of such modified blade head arrangements are shown in FIGS. 6 through 12 and discussed below.

In FIGS. 6-12, 30 points to a plate at the front of a ride-on machine such as that shown in FIG. 3. A walk-behind machine like that shown in FIG. 1 may be provided with a similar plate.

Figure 6:
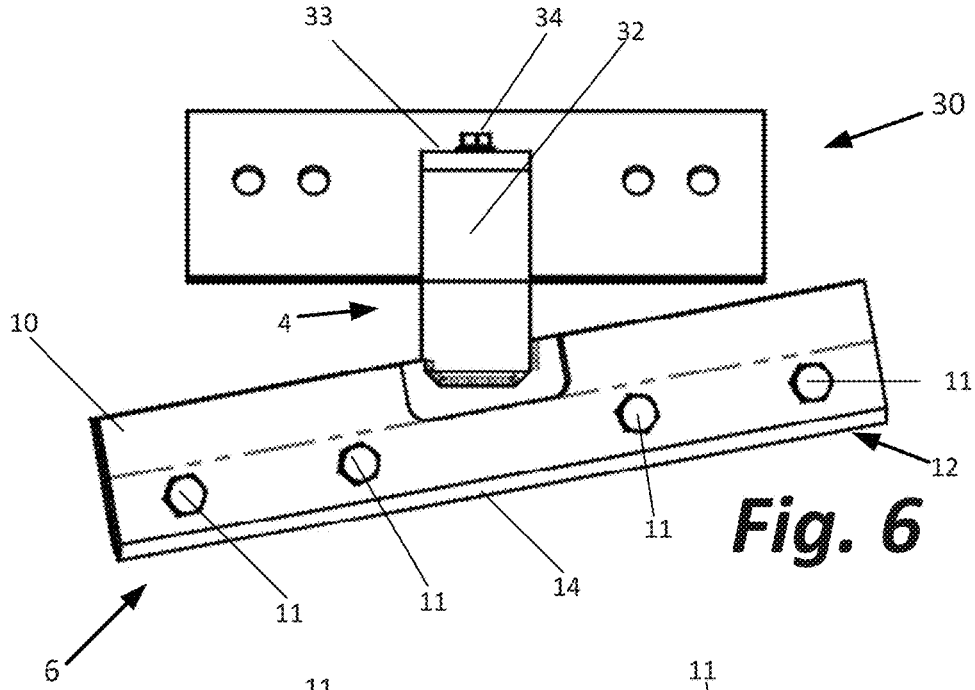
FIG. 6 is a top view of a novel swivel blade head adapted to hold the blade at an angle other than perpendicular to the direction of travel of the vehicle when the leading edge of the blade engages the floor to be scraped.
Figure 7:
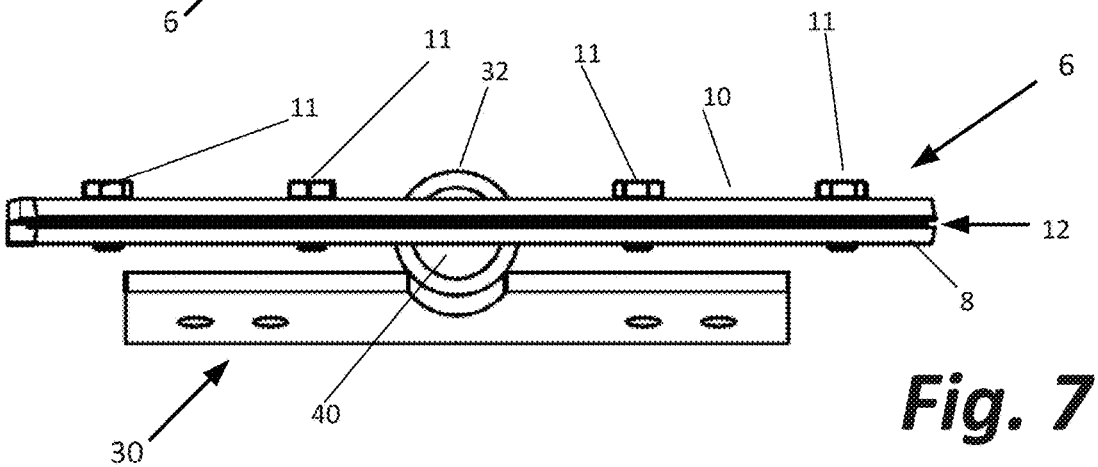
FIG. 7 is a first front view of the swivel blade head of FIG. 6 in a first position.
Figure 8:
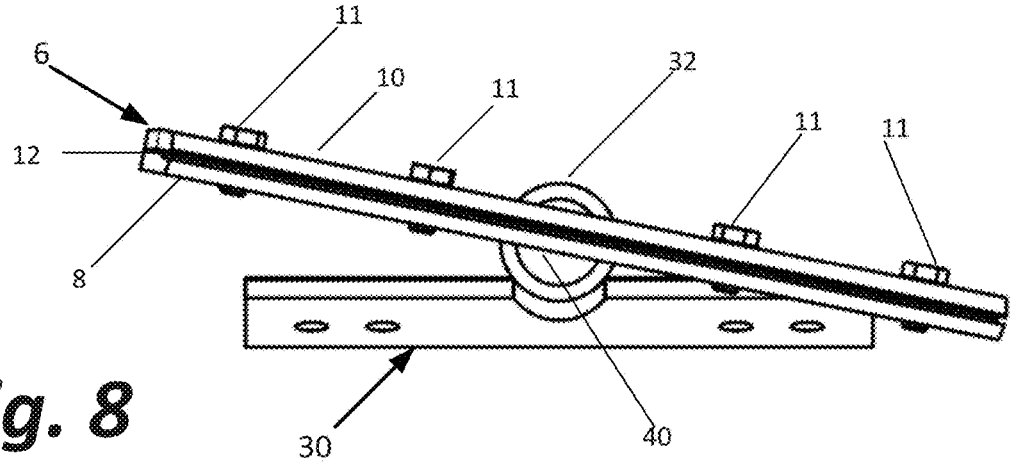
FIG. 8 is a second front view of the swivel blade head of FIG. 6 in a second position.

The embodiment shown in FIGS. 6 through 8 is intended to be coupled to a machine such as machine 30 (or machine 1) via a socket or collar 32. To enable such a connection, the blade assembly includes a connector 4 comprising a shank 40 having a first end adapted to be inserted into the socket 32. A washer 33 is then bolted to the end of the shank 40 using bolt 34 to hold the shank 40 in the collar 32. The bolt and washer 33 act to lock the shank 40 in the collar 32 while allowing the shank 40 to rotate about the longitudinal axis of the shank 40 relative to the collar 32. The connector 4 further includes a connection to plate 8. For example, a weld may be used to couple plate 8 to shank 40. The plate 8 extends at an angle other than 90° from the longitudinal axis of shank 40 and also at about this same angle relative to the direction of travel of the machine. A blade 12 is clamped between a top plate 10 and the bottom plate 8. This is achieved by placing the blade 12 between plates 8/10, aligning holes in the top and bottom plates 8/10, and then coupling the plates 8/10 together by applying bolts 11. Ideally, these holes in the bottom plate 8 are threaded and the threads of these holes cooperate with the threads of the bolts 11 to fasten the blade 12 between the top plate 10 and bottom plate 8.

Figure 9:
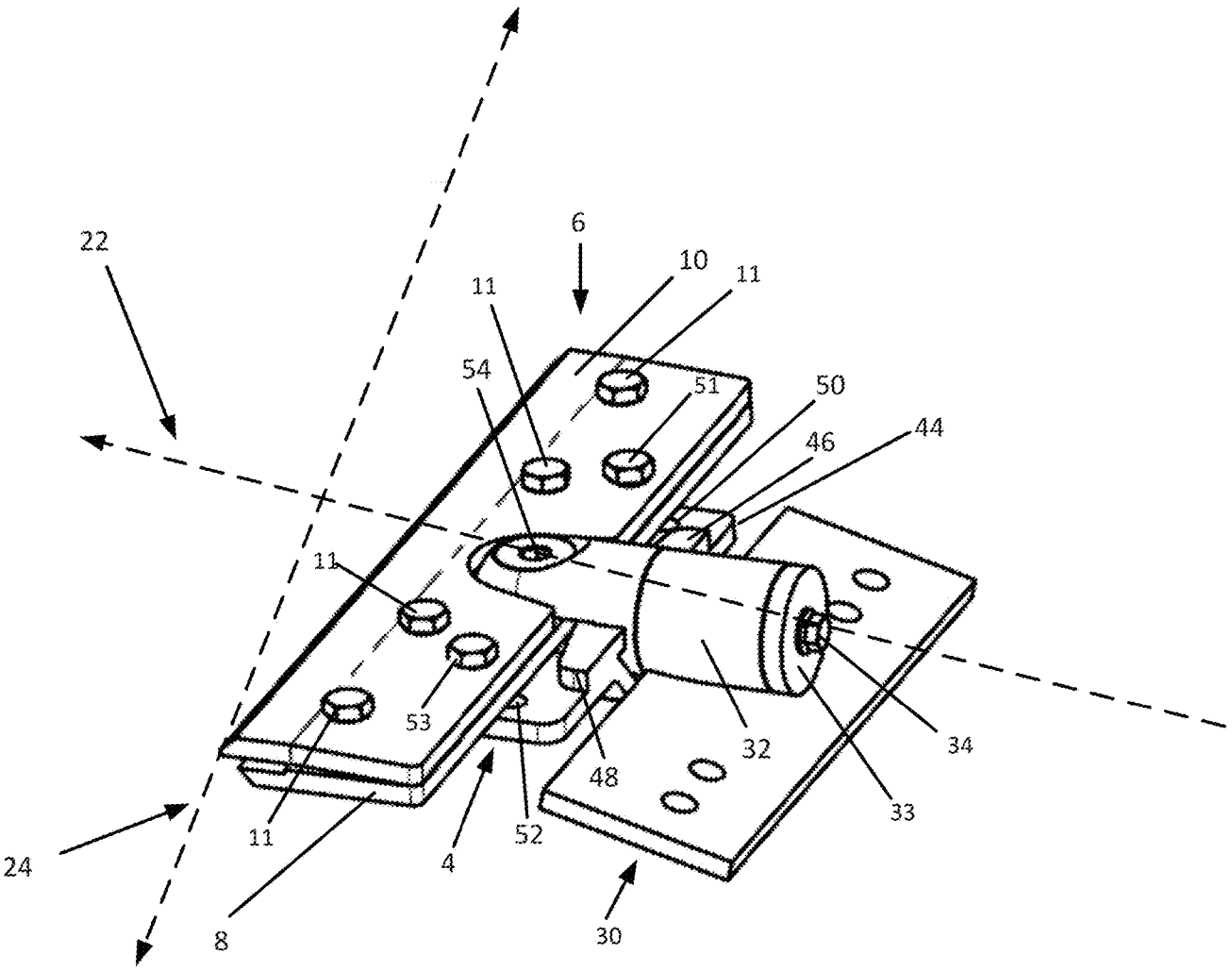
FIG. 9 is a perspective view of a first alternative swivel blade head in which the angle of the leading edge of the blade is adjustable relative to the direction of travel of the floor scraping machine.
Figure 10:
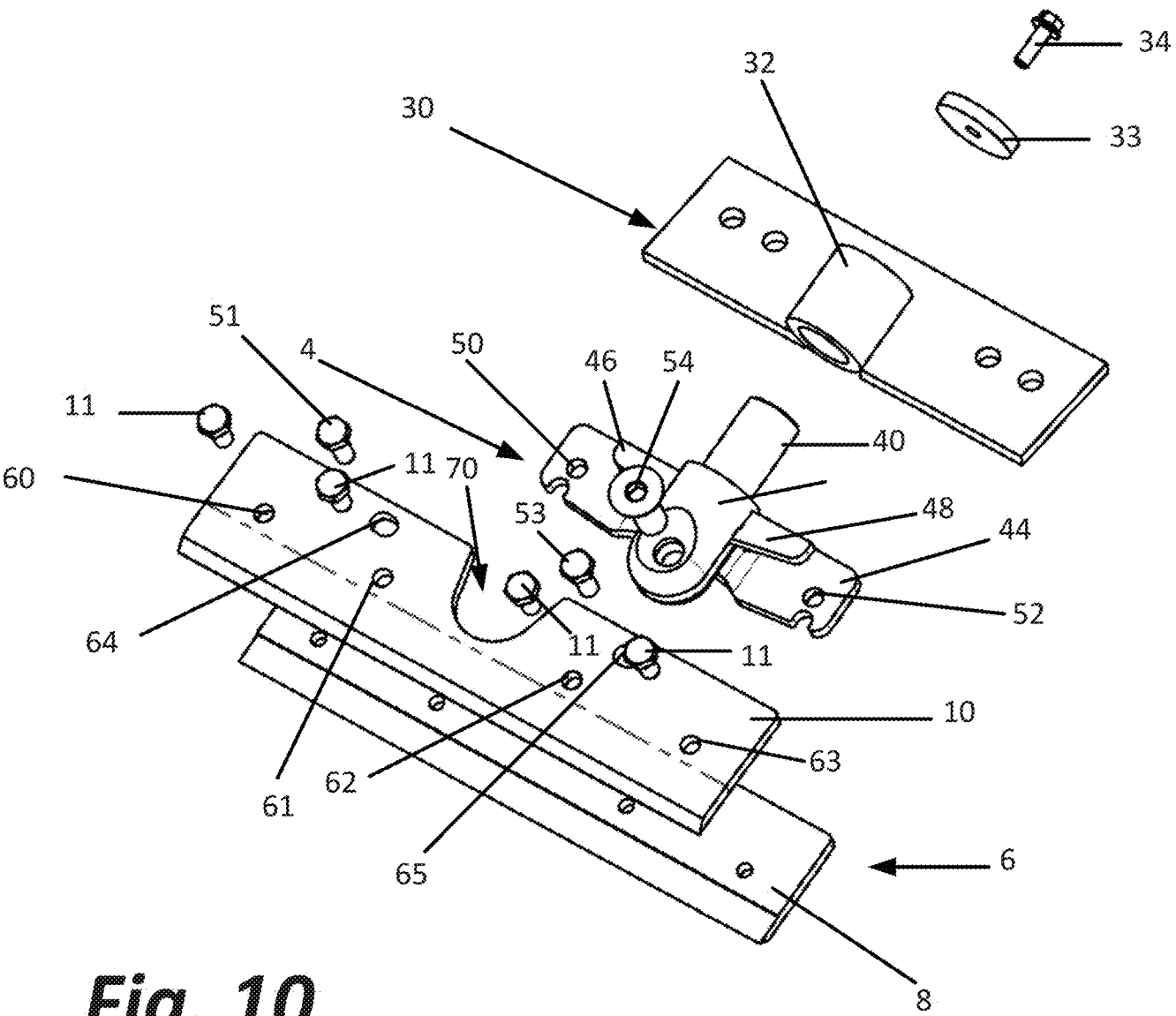
FIG. 10 is an exploded perspective view of the first alternative swivel blade head of FIG. 9.

FIGS. 9 and 10 show an embodiment similar to that shown in FIGS. 6-8. However, in the embodiment shown in FIGS. 9 and 10, the angle of the blade head 6 is adjustable relative to the connector and the direction of travel of the scraping machine. In the embodiment of FIGS. 9 and 10, the connector 4 includes a plate 44 connected to the shank 40. The plate 44 extends perpendicular to shank 40 and also perpendicular to the machine's direction of travel.

Projecting upwardly from the plate 44 are a pair of stops 46 and 48. The plate 44 also includes at least two holes 50 and 52 extending through the plate 44. These holes may be threaded to cooperate with the threads of bolts 51 and 53.

The blade head 6 is adapted to be attached to plate 44. In the embodiment shown in FIGS. 6 and 7, the bottom surface of bottom plate 8 of the blade head 6 is in face-to-face registration with the top surface of plate 44 and pivotally coupled to plate 44 by a pin 54. This arrangement allows the bottom plate 8 to be rotated back and forth about the longitudinal axis of pin 54 between the stops 46 and 48. More specifically, and when viewed from above, bottom plate 8 can be rotated in the clockwise direction until the back edge of the bottom plate 8 engages stop 46 and in the counterclockwise direction until the back edge of plate 8 engages stop 48.

After a blade is positioned between plates 8 and 10, plates 8 and 10 are bolted together using bolts 11. The blade head 6 and blade are then rotated either in the clockwise or counterclockwise direction until one of the stops 46 or 48 is engaged by the back of the bottom plate 8. When the back of bottom plate 8 is in contact with stop 46, hole 64 passing through the bottom plate 8 and top plate 10 is aligned with hole 50 in plate 44. A bolt 51 cooperates with these holes to lock the blade 12 and blade head 6 at the desired angle. Alternatively, when the back of the bottom plate 8 is in contact with stop 48, hole 65 extending through the bottom plate 8 and top plate 10 is aligned with hole 52 in plate 44. Again, a bolt 53 cooperates with these holes to lock the blade head 6 and a blade held by the blade head at the desired angle. Of course, the pivot pin 54 can be eliminated in which case locking of the blade head 6 and blade 12 at the desired angle may be achieved using at least both bolts 51 and 53 and at least two sets of aligned holes in plate 44 of the connector 4 and the top and bottom plates 8 and 10 of the blade head 6.

When the back of the bottom plate 8 engages either stop 46 or 48, the leading edge 14 of blade 12 is oriented at an angle other than perpendicular to the direction of travel of the machine. More specifically, the leading edge 14 of the blade 12 is neither co-linear with or parallel to an imaginary line 24 that is parallel to the floor, perpendicular to the direction of travel, and extends through the forward most point of the blade 12. The angle between this imaginary line and the leading edge of the blade 12 is in the range of 5° to 45°. This is true whether the stop 46 or the stop 48 is engaged.

Various modifications can be made to the embodiment of FIGS. 9 and 10 without deviating from the invention. As mentioned above, the pivot pin can be eliminated. The shape of the stops can be modified to increase or decrease the size of the arc through which the blade head swings. Additional holes may be provided in the plates 44, 8 and 10 through which bolts can be inserted not only to lock the angle of the blade head and blade relative to the direction of travel of the machine, but also to act as stops thus eliminating the need for stops 46 and 48. Further, the holes either in plate 44 or in plates 8 and 10 can be curved slots allowing for infinite adjustment of the angle of the leading edge of the blade between two finite boundaries such as those imposed by stop 46 and 48.

Figure 11:
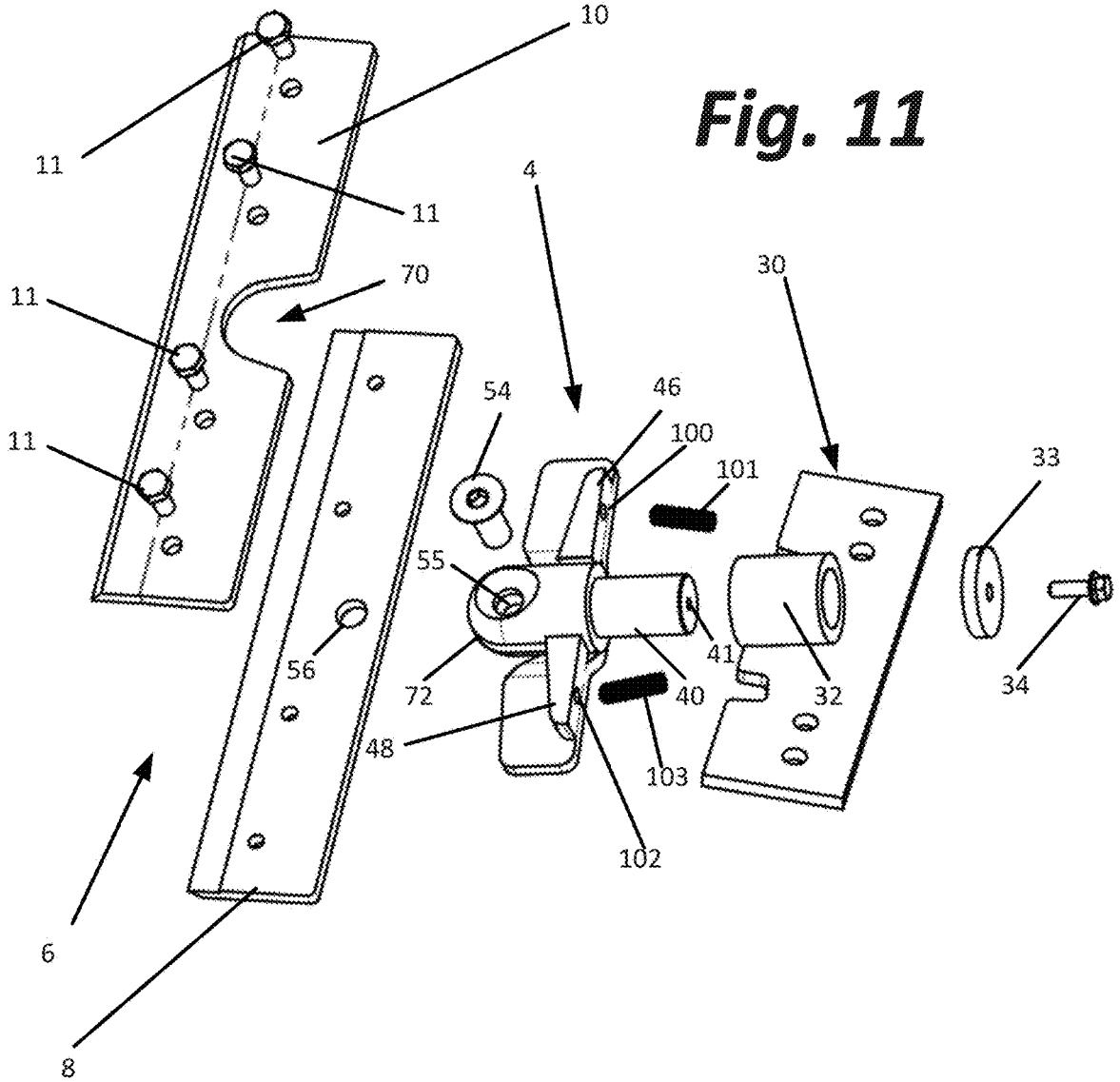
FIG. 11 is an exploded perspective view of a second alternative swivel blade head which allows the angle of the leading edge of a blade to be infinitely adjusted relative to the direction of travel of the floor scraping machine.
Figure 12:
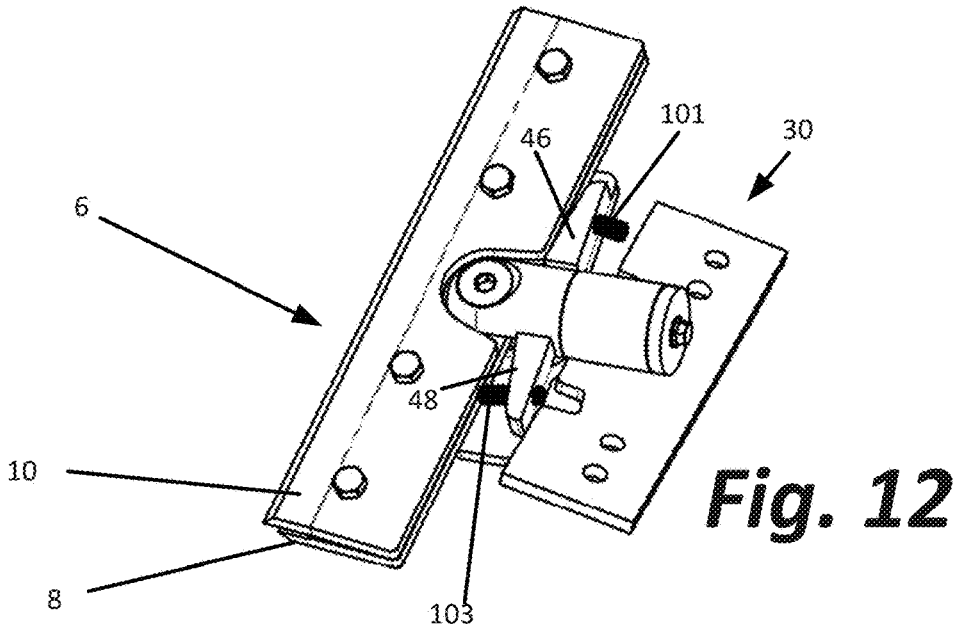
FIG. 12 is a second perspective view of the second alternative swivel blade head of FIG. 11.

As illustrated in FIGS. 11-12, the stops 46 and 48 may also be modified to include threaded holes 100 and 102 extending through the stops from front to back. These holes receive set screws 101 and 103 which each have an end that abuts against at least one of plates 8 and 10 to establish a desired angle between the blade head 6 and the shank 40 of the connector 4. The distance these set screws project from the stops 46 and 48 can be independently adjusted to adjust the angle of the blade and blade head 6 relative to the longitudinal axis of the shank 40 and direction of travel of the vehicle. In the case of this embodiment, the blade head 6 is coupled to the connector 4 by threaded pin 54 which passes through an opening 55 in the connector 4 and mates with a threaded hole 56 in the bottom plate 8 of the blade head 6. The top plate 10 may be provided with a notch 70 which receives a projection 72 of the connector 4 which has an opening through which the shaft of pin 54 passes.

It should be understood that, within the scope of the following claims, the invention may be practiced otherwise than as specifically shown in the drawings and described above. The foregoing description is intended to explain the various features and advantages, but is not intended to be limiting. The scope of the invention is defined by the following claims which are also intended to cover a reasonable range of equivalents.

What is claimed is:

1. A floor stripping blade assembly adapted to be attached to a floor stripping machine, said floor stripping machine adapted to push the floor stripping blade assembly across a floor in a direction of travel, said floor stripping blade assembly comprising a leading edge, a trailing edge, a first side edge extending between the leading edge and the trailing edge, a second side edge extending between the leading edge and the trailing edge, wherein said first side edge and said second side edge are parallel to each other and said leading edge extends between the first side edge and the second side edge at a first acute angle within a first range of between 85 degrees and 45 degrees from said first side edge and at a second angle within a second range of between 5 degrees and 45 degrees from an imaginary line parallel to the floor and perpendicular to the direction of travel, and wherein said blade assembly further comprises a first wing extending upwardly from and along the first side edge and a second wing extending upwardly from and along the second side edge.

2. The floor stripping blade assembly of claim 1 wherein said second angle is adjustable within said second range.

3. The floor stripping blade assembly of claim 1 wherein said second angle is infinitely adjustable within said second range.

4. The floor stripping blade assembly of claim 1 wherein the leading edge and the trailing edge are not parallel to each other.

5. The floor stripping blade assembly of claim 1 further comprising a blade head having a blade holding assembly including a top plate and a bottom plate, and wherein a portion of the blade assembly extending between the leading edge and the trailing edge is clamped between and held by the top plate and bottom plate.

6. The floor stripping blade assembly of claim 5 wherein the blade holding assembly is at an angle adjustable relative to the direction of travel.

7. The floor stripping blade assembly of claim 6 wherein the blade head further includes at least one stop surface and at least one fastener adapted to secure the blade holding assembly at a preselected angle relative to the direction of travel.

8. The floor stripping blade assembly of claim 5 wherein said blade head is secured to a blade connector at a preselected angle.

9. The floor stripping blade assembly of claim 8 wherein the preselected angle is adjustable.

10. The floor stripping blade assembly of claim 8 wherein said blade connector comprises a shank adapted to be inserted into a socket of a floor stripping machine.

11. A floor stripping blade assembly adapted to be attached to a floor stripping machine, said floor stripping machine adapted to push the floor stripping blade assembly across a floor in a direction of travel, said floor stripping blade assembly comprising a blade having a trapezoidal shape comprising a leading edge, a trailing edge, a first side edge extending between the leading edge and the trailing edge, a second side edge extending parallel to the first side edge and between the leading edge and the trailing edge, wherein said leading edge extends between the first side edge and the second side edge at a first acute angle within a first range of between 85 degrees and 45 degrees from said first side edge and at a second angle within a second range of between five degrees and 45 degrees from an imaginary line perpendicular to the first side edge, and wherein said blade portion further comprises a first wing extending upwardly from and along the first side edge and a second wing extending upwardly from and along the second side edge.

12. The floor striping blade assembly of claim 11 further comprising a blade head coupled to the blade and a blade shank attached to the blade head.

13. A floor stripping blade assembly adapted to be attached to a floor stripping machine, said floor stripping machine having a receiver socket and being adapted to push the floor stripping blade assembly across a floor in a direction of travel, said floor stripping blade assembly comprising:

a. a blade having a leading edge, a trailing edge, a first side edge extending between the leading edge and the trailing edge, a second side edge extending parallel to the first side edge and between the leading edge and the trailing edge, wherein said leading edge extends between the first side edge and the second side edge at a first acute angle within a first range of between 85 degrees and 45 degrees from said first side edge, and wherein said blade further comprises a first wing extending upwardly from and along the first side edge and a second wing extending upwardly from and along the second side edge;

b. a blade head coupled to the blade;

c. a blade shank attached to the blade head and adapted to be coupled to the receiver socket so that a portion of the machine is supported by the floor stripping blade assembly when the leading edge is in a floor stripping position, and the leading edge of the blade is also at a second angle within a second range of between 5 degrees and 45 degrees of an imaginary line parallel to the floor and perpendicular to the direction of travel when the leading edge is in said floor stripping position.

* * * * *